US008327815B2

(12) United States Patent
Hale et al.

(10) Patent No.: US 8,327,815 B2
(45) Date of Patent: Dec. 11, 2012

(54) ADJUSTABLE CAMSHAFT WITH A PLANETARY GEAR

(75) Inventors: Thomas Hale, Northampton (GB); Jonathan Hall, Northamptonshire (GB); Hermann Hoffmann, Stuttgart (DE); Gordon Taylor, Northamptonshire (GB)

(73) Assignee: Mahle International GmbH (DE)

( * ) Notice: Subject to any disclaimer, the term of this patent is extended or adjusted under 35 U.S.C. 154(b) by 537 days.

(21) Appl. No.: 12/595,573

(22) PCT Filed: Apr. 9, 2008

(86) PCT No.: PCT/EP2008/054297

§ 371 (c)(1),
(2), (4) Date: Oct. 12, 2009

(87) PCT Pub. No.: WO2008/125569

PCT Pub. Date: Oct. 23, 2008

(65) Prior Publication Data

US 2010/0064998 A1 Mar. 18, 2010

(30) Foreign Application Priority Data

Apr. 13, 2007 (DE) ..... 10 2007 017 897

(51) Int. Cl.
*F01L 1/34* (2006.01)

(52) U.S. Cl. ..... 123/90.17

(58) Field of Classification Search ..... 123/90.15, 123/90.17
See application file for complete search history.

(56) References Cited

U.S. PATENT DOCUMENTS

| | | | | |
|---|---|---|---|---|
| 4,305,352 | A | 12/1981 | Oshima et al. | |
| 4,583,501 | A * | 4/1986 | Williams | 123/90.15 |
| 4,802,376 | A * | 2/1989 | Stidworthy | 475/16 |
| 5,117,784 | A * | 6/1992 | Schechter et al. | 123/90.17 |
| 5,121,717 | A * | 6/1992 | Simko et al. | 123/90.17 |
| 6,122,984 | A | 9/2000 | Willmot | |
| 6,328,008 | B1 | 12/2001 | Io | |
| 7,438,034 | B2 * | 10/2008 | Meintschel et al. | 123/90.17 |

(Continued)

FOREIGN PATENT DOCUMENTS

DE 2842154 4/1979

(Continued)

OTHER PUBLICATIONS

English abstract for DE-3737602.

(Continued)

*Primary Examiner* — Thomas Denion
*Assistant Examiner* — Daniel Bernstein
(74) *Attorney, Agent, or Firm* — Rader, Fishman & Grauer PLLC

(57) ABSTRACT

The present invention relates to an adjustable camshaft (1), which is connected to a crankshaft via a sprocket/belt pulley (3) and has a phase adjusting device (4) for adjusting the phase between the camshaft (1) and the crankshaft. The essential idea of the invention is that the phase adjusting device (4) comprises a planetary gear (5) having at least two sun wheels (6 and 7) disposed coaxially to each other and planet wheels (8) surrounding said sun wheels, wherein said planet wheels are rotatably supported on a planet wheel carrier (10) via a planet wheel axis (9). Said planet wheel carrier (10) can be rotated in relation to the camshaft axis (11), wherein a rotation of the planet wheel carrier (10) brings about a phase adjustment between the camshaft (1) and the drive.

18 Claims, 6 Drawing Sheets

U.S. PATENT DOCUMENTS

Figure 1:
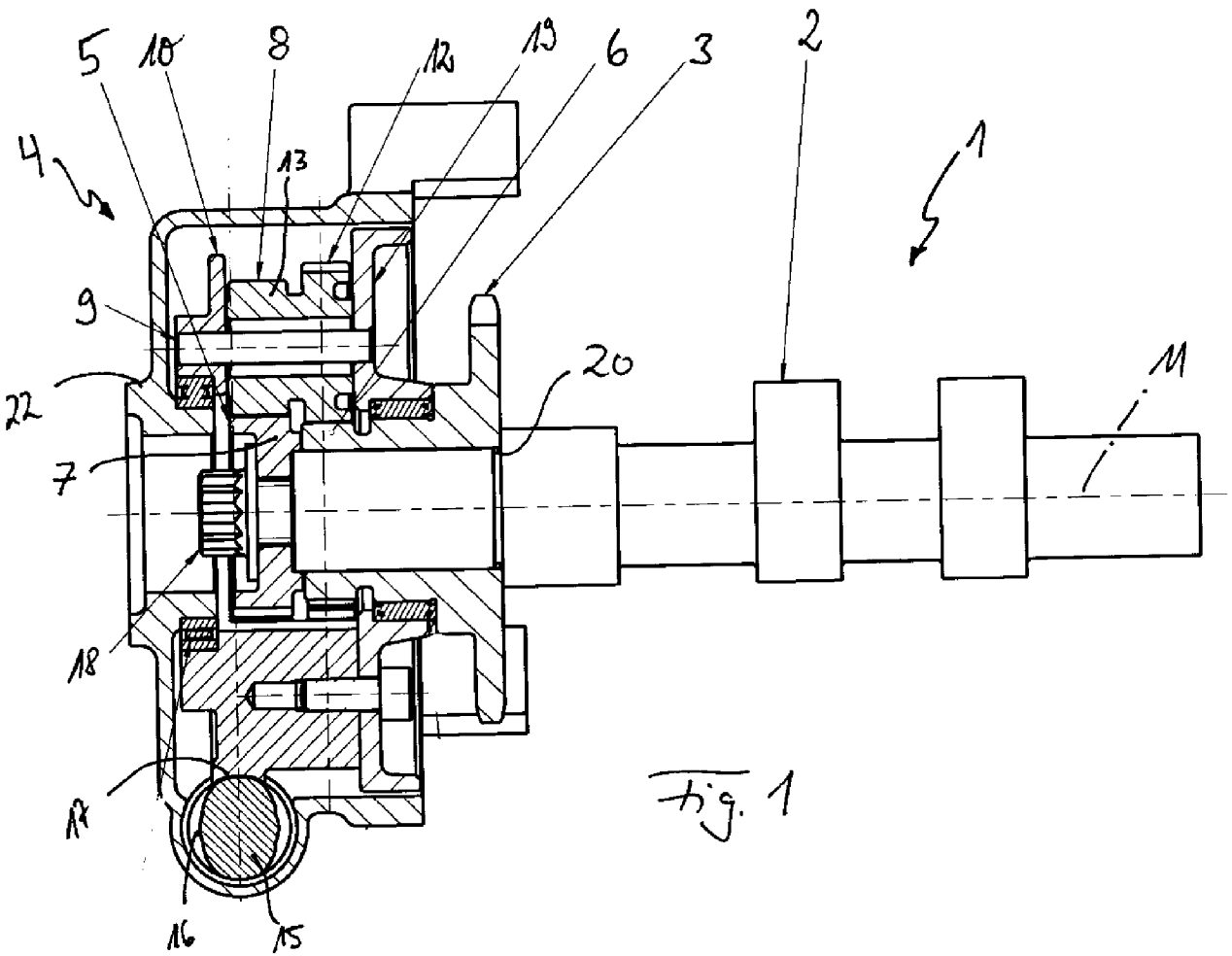

| | | | | |
|---|---|---|---|---|
| 2001/0020460 | A1 | 9/2001 | Heer | |
| 2003/0145816 | A1 * | 8/2003 | Lehmann | 123/90.17 |
| 2003/0226532 | A1 | 12/2003 | Takenaka et al. | |
| 2004/0206322 | A1 | 10/2004 | Meintschel et al. | |

FOREIGN PATENT DOCUMENTS

| | | |
|---|---|---|
| DE | 3737602 | 5/1989 |
| DE | 4133408 | 4/1993 |
| DE | 4133408 A1 * | 4/1993 |
| DE | 19801679 | 7/1999 |
| DE | 10037942 | 8/2000 |
| DE | 10315151 | 4/2003 |
| DE | 10317607 | 11/2003 |
| DE | 69633258 | 8/2004 |
| EP | 0396280 | 4/1992 |
| EP | 1136657 | 9/2003 |
| WO | WO-87/03335 | 6/1987 |

OTHER PUBLICATIONS

English abstract for DE-19801679.
English abstract for DE-4133408.

* cited by examiner

ADJUSTABLE CAMSHAFT WITH A PLANETARY GEAR

CROSS-REFERENCES TO RELATED APPLICATION

This application is a National Stage application which claims the benefit of International Application No. PCT/EP 2008/054297filed Apr. 9, 2008 , which claims priority based on German Patent Application No. 102007017897.4 , filed Apr. 13, 2007 , both of which are hereby incorporated by reference in their entirety.

The invention relates to an adjustable camshaft, in particular for internal combustion engines of motor vehicles, according to the preamble of claim 1.

Conventionally, adjustable camshafts are used to control the valve opening times of the inlet and/or outlet valves of an internal combustion engine, in particular to adjust it to a rotational speed and/or a load of the engine. To change the valve opening times, the adjustable camshafts comprise an adjusting device.

An adjustable camshaft of the generic type is, for example, disclosed in document EP 0 396 280, which comprises a planetary gear as an adjusting device. A driving force is transferred from a sprocket/belt pulley to a planet wheel carrier and is introduced to the planetary gear in this manner. A phase adjustment occurs via a drive shaft that is connected in an intermeshing manner to at least one of the planet wheels.

An additional adjustable camshaft is disclosed in document DE 28 42 154 A1. In this adjustable camshaft, a driving force is introduced to the planetary gear by means of a sun wheel and is furthermore transferred to a camshaft by means of a ring wheel having an internally positioned toothed ring that intermeshes with at least one of the planet wheels. A planet wheel carrier rotates about the axis of the camshafts to create a phase adjustment.

Document DE 103 17 607 A1 discloses an adjustment device that comprises an electric motor for phase adjustment. Depending on the embodiment, this can, for example, act upon a planet wheel or a control pin.

The invention is concerned with the problem of providing an improved embodiment of a camshaft of the generic type which characterises itself, in particular, by being simpler to manufacture.

This problem is solved by means of the subject matter of the independent claim 1. Advantageous embodiments are subject matter of the dependent claims.

The invention is based on the general concept of developing in an adjustable camshaft a phase adjusting device having a planetary gear in such a manner that, one, a phase adjustment is effected between the camshaft and a drive by means of a rotation of a planet wheel carrier and, two, driving or driving the planetary gear is undertaken by two sun wheels that are arranged coaxially to one another. The adjustable camshaft according to the invention is particularly well-suited for internal combustion engines of motor vehicles and is connected to a drive, for example a crankshaft, by means of a connecting member, preferably a sprocket/belt pulley. The two sun wheels, which are arranged coaxially with regard to one another, are surrounded by planet wheels, the first sun wheel being connected in a rotationally-fixed manner to the drive, that is to say to the sprocket/belt pulley, and the second sun wheel being connected in a rotationally-fixed manner to the camshaft. All planet wheels are thus respectably rotatably mounted on a planet wheel carrier by means of a planet wheel axis, the rotating of the planet wheel effecting the phase adjustment between the camshaft and the drive. By means of a phase adjustment configured in such a manner, the camshaft can altogether be manufactured in a considerably simpler manner. Moreover, a particularly compact and simultaneously highly dynamic manner of construction can be achieved by means of a planetary gear configured in such a manner, which is a particular advantage in the light of the space availability in modern engine compartments that are increasingly becoming smaller. Furthermore, the camshaft according to the invention is characterised by an extremely high degree of running smoothness. Additional advantages are, for example, a smaller inertia of mass and a concomitantly improved adjustment possibility as well as a considerably enlarged adjusting angle in comparison to conventional phase adjusting devices.

The planetary gear is advantageously configured in such a manner that it effects a transmission of a rotary motion from the drive to the camshaft. A transmission ratio, which is customarily 2:1 from the crank to the camshaft, can be accomplished in a particularly simpler and yet more precise manner by means of a corresponding configuration of the sun wheels or of the planet wheels surrounding said sun wheels.

According to a particularly preferred embodiment of the solution according to the invention, a drive device for actuating the phase adjusting device, that is to say for rotating the planetary wheel carrier, is provided that engages by means of a worm gear with a toothed track arranged on the planetary wheel carrier. The transmission of the rotary forces from the drive device to the planetary wheel carrier by means of a worm gear that engages with the toothed track permits a particularly finely adjustable rotation of the planet wheel carrier and thereby a particularly exact possibility for phase adjustment.

In yet a further advantageous embodiment, the camshaft comprises an internal shaft arranged coaxially in an external shaft, said internal shaft being connected in a rotationally-fixed manner with first cams, while the external shaft is connected in a rotationally-fixed manner with second cams, wherein the interior shaft is rotatably mounted relative to the exterior shaft, and wherein a second phase adjusting device is provided for generating this relative motion. This makes possible not only the control of the valve opening times of the intake valves, but also those of the outlet valves by means of which the performance of an internal combustion engine equipped with the camshaft according to the invention can be increased even further.

Advantageous exemplary embodiments, which are explained in greater detail below, are represented in the drawings.

The drawings show schematically in

Figure 2:
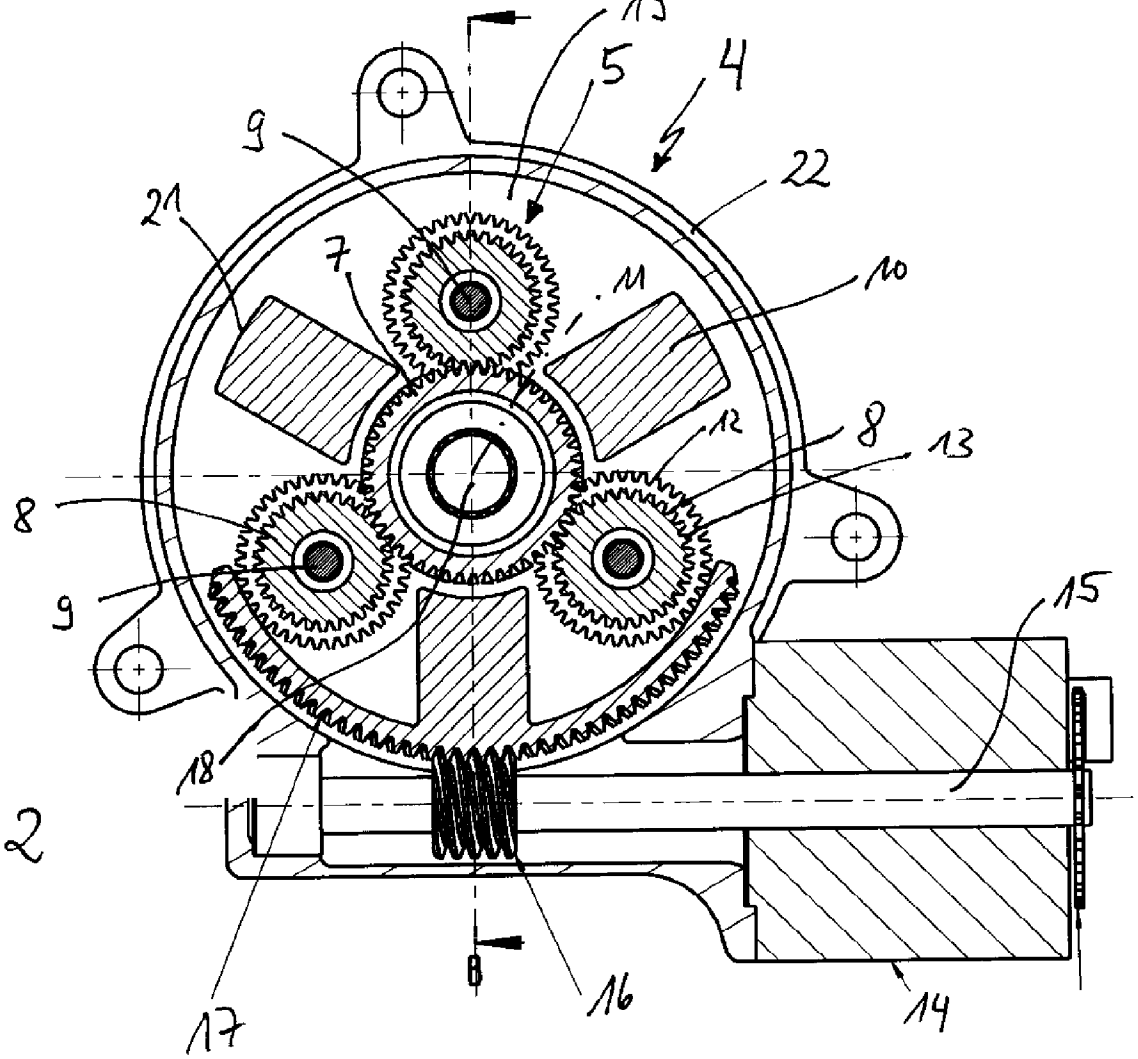
Figure 3:
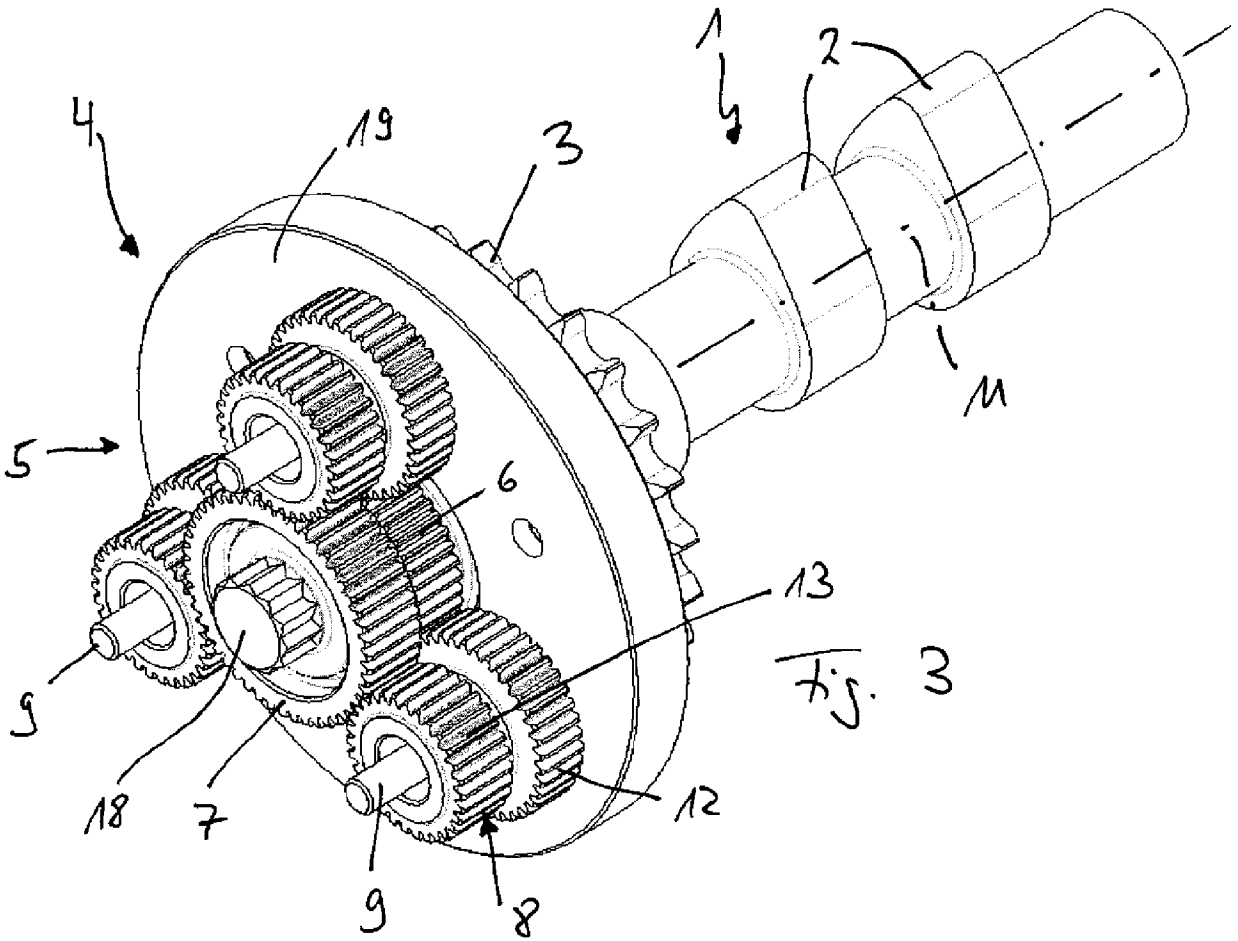
Figure 4:
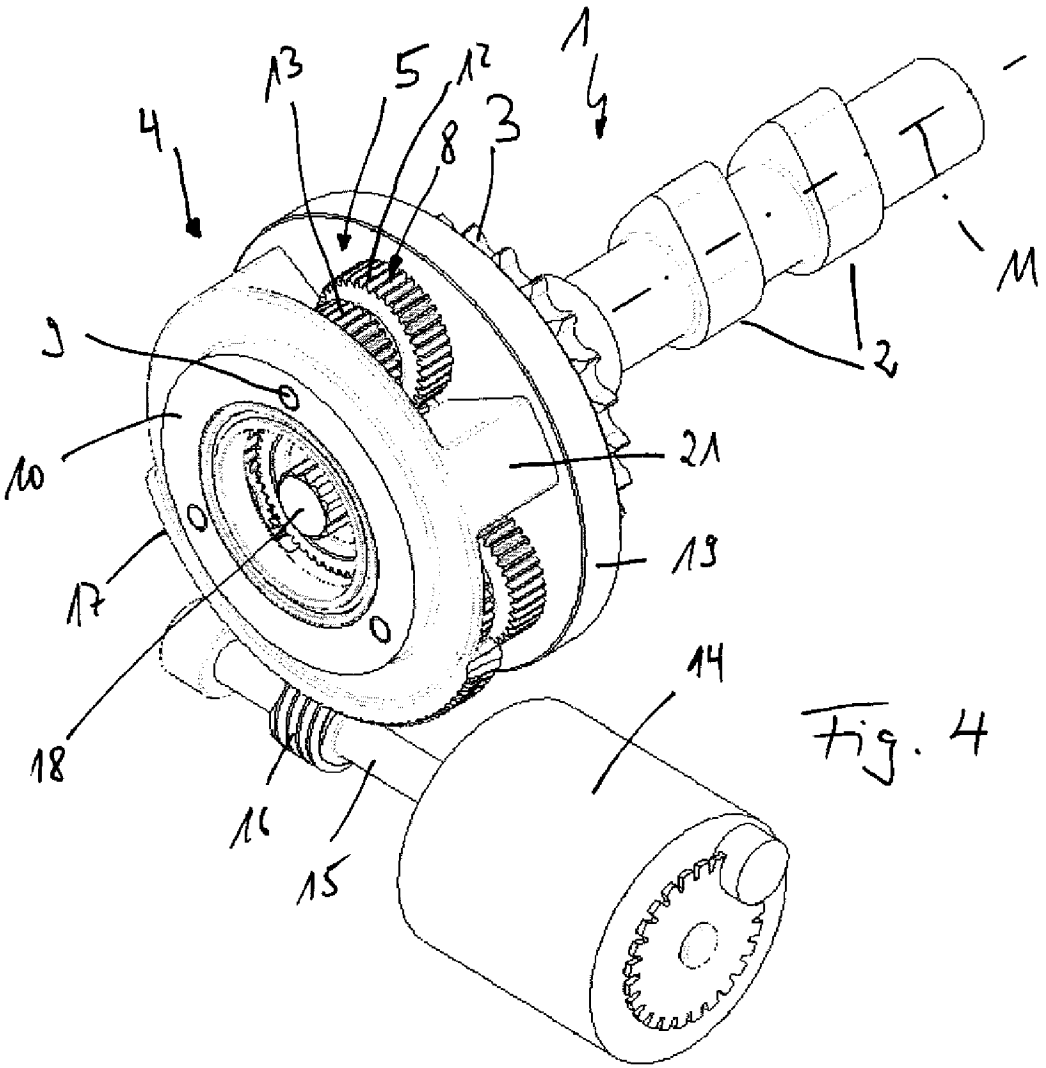
Figure 5:
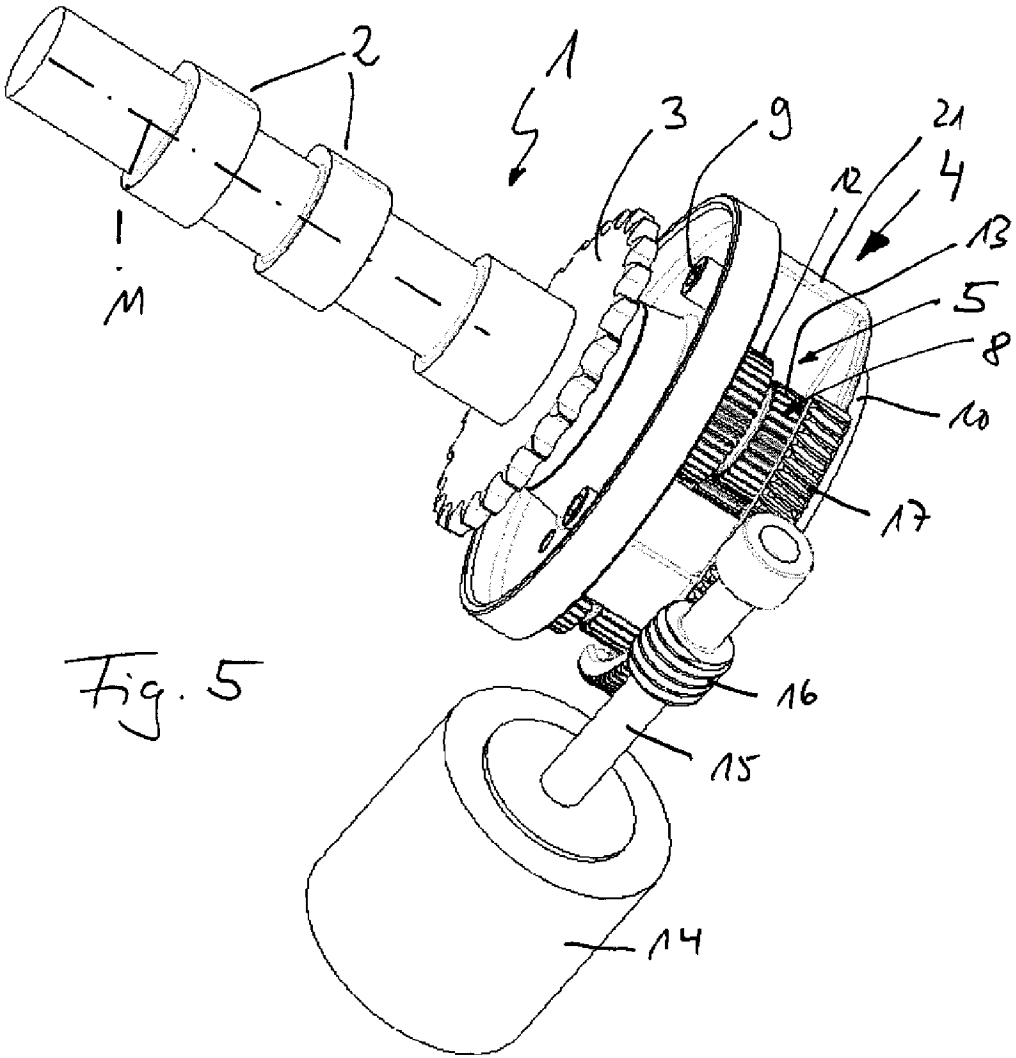
Figure 6:
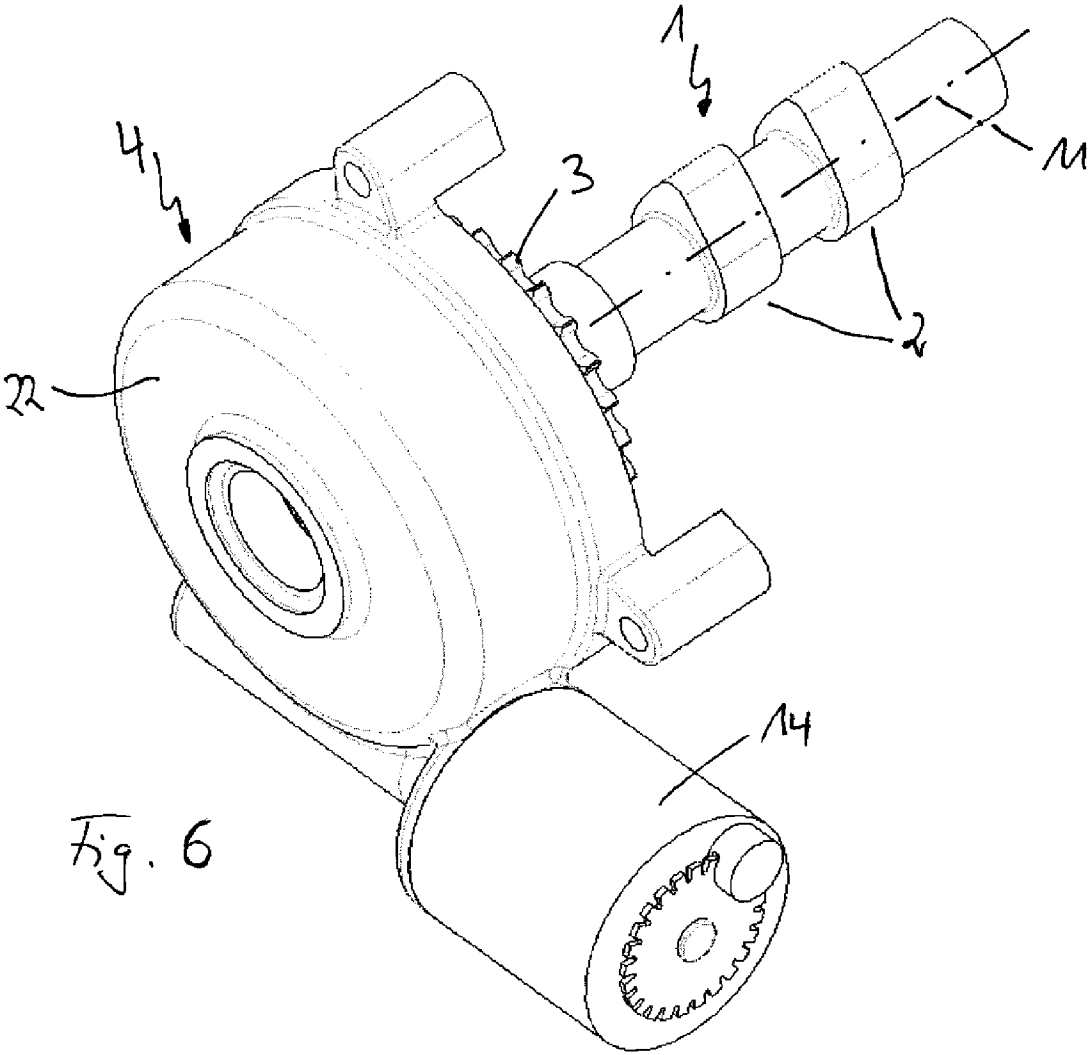

FIG. 1 a partial longitudinal section through an adjustable camshaft according to the invention in the region of a phase adjusting device, FIG. 2 a cross-section through the phase adjusting device, FIG. 3 a representation of a planetary gear of the phase adjusting device, FIG. 4 a representation as in FIG. 3 with attached planet wheel carrier and a drive device engaging therewith, FIG. 5 a representation as in FIG. 4, however from a different perspective, FIG. 6 a completely faired phase adjusting device.

According to FIG. 1, an adjustable camshaft 1 comprises a plurality of cams 2 with which, for example, the valve opening times of intake valves and/or outlet valves of an internal combustion engine, which is not shown, are controlled. The cams 2 comprise an eccentric shape characteristic therefor. The adjustable camshaft 1 is connected to a drive, which is not shown, in particular with a crankshaft of the internal combustion engine, by means of a sprocket/belt pulley 3. A phase adjusting device 4 is arranged on the side of the longitudinal end of the camshaft 1, said phase adjusting device being configured to adjust the phases between a camshaft 1 and a drive, that is to say the sprocket/belt pulley 3.

The phase adjusting device 4 comprises a planetary gear 5 (compare also the FIGS. 2 to 5) with at least two sun wheels 6 and 7, which are arranged coaxially to one another, as well and as planet wheels 8 surrounding said sun wheels. The first sun wheel 6 operatively interacts with the second sun wheel 7 by means of the planet wheel 8. Moreover, the first sun wheel 6 is connected in a rotationally-fixed manner to the sprocket/belt pulley 3 and thus to the drive, while the second sun wheel 7 is connected in a rotationally-fixed manner to the camshaft 1. According to an advantageous development, the first sun wheel 6 is a component of the sprocket/belt pulley 3 and/or, as is shown in FIG. 1, is configured integrally therewith.

The planetary wheels 8, of which FIG. 1 shows only a single cross-section, are each respectively mounted in a rotatable-manner on a planet wheel carrier 10 by means of a planet wheel axis 9. The planet wheel carrier 10, in turn, is rotatable with regard to the camshaft axis 11, wherein a rotation of the planet wheel carrier 10 effects a phase adjustment between the camshaft 1 and a drive, that is to say the sprocket/belt pulley 3.

As can further be seen in FIG. 1, the planet wheels 8 or the planet wheel 8 shown in cross-section in FIG. 1, are configured as stepped, their respective first step 12 intermeshing with the first sun wheel 6, and their respective second step 13 intermeshing with the second sun wheel 7. A transmission of a rotary motion occurs from the sprocket/belt pulley 3 to the camshaft 1 through the planet gear 5 owing to the diameters of the first and second steps 12 and 13 having differently sized diameters with a respectively different number of teeth as well as furthermore owing to the fact that the first sun wheel 6 likewise has a different diameter and a different number of teeth in comparison to the second sun wheel 7.

As previously mentioned, the planet wheel carrier 10 is rotatably mounted about the camshaft axis 11, wherein a rotation of the planet wheel carrier 10 effects a phase adjustment between the sprocket/belt pulley 3 and the camshaft 1. In order to rotate the planet wheel carrier 10, a drive device 14 (compare FIG. 2), for example an electric engine, is provided. It goes without saying that it is also conceivable that the drive device 14 is operated pneumatically or hydraulically.

It can be seen in FIG. 2 that a shaft 15 of the drive device 14 carries a worm gear 16 that intermeshes with a toothed track 17 arranged on the planet wheel carrier 10. A toothed gearing is thus provided between the drive device 14 and the planet wheel carrier 10. This toothed gearing, which comprises the toothed track 17 as well as the worm gear 16, represents only one possible embodiment, meaning that other adjusting mechanisms for rotating the planet gear carrier 10 are also intended to be comprised by the invention.

In reference to FIG. 1, it is apparent that the drive force for the camshaft 1 is introduced to the planetary gear 5 by means of the sprocket/belt pulley 3, wherein the rotational force is transmitted from the first sun wheel 6 to the first step 12 of the planet wheel 8 and, from there, to the second step 13 of the planet wheel 8. The second step 13 of the planet wheel 8 intermeshes with the second sun wheel 7 in such a manner that a power transmission likewise occurs here.

According to FIG. 1, the second sun wheel 7 is tensioned against a front face of the camshaft 1 by means of an axial fixing element 18, here represented in the style of a screw, in such a manner that the second sun wheel 7 is connected in a rotationally-fixed manner to the camshaft 1.

The planet wheel axis 9 is fixedly mounted on one end in the planet wheel carrier 10, while its end opposite the planet wheel carrier 10 is fixedly mounted in a cover plate 19. The cover plate 19 is, in turn, rotatably mounted with reference to the sprocket/belt pulley 3. According to FIGS. 1 to 6, a camshaft 1 is shown in which either the opening times of the intake valves or the opening times of the outlet valves can be controlled by means of the phase adjusting device 4.

Such a phase adjusting device 4 according to the invention is, however, also conceivable for adjustable camshafts having an interior shaft coaxially arranged in an exterior shaft in which the interior shaft is a rotatably connected to the first cams and the exterior shaft is rotatably connected to second cams and wherein the interior shaft is rotatably mounted relative to the exterior shaft. In such an embodiment of the camshafts, both the opening times for the intake valves as well as the opening times for the outlet valves can then be controlled. In order to generate a relative rotation of the interior shaft with regard to the exterior shaft, a second phase adjusting device is then preferably provided that, for example, can be arranged coaxially to the first phase adjusting device 4.

Generally, the camshaft 1 according to the invention functions as follows:

The sprocket/belt pulley 3 is driven by a drive, for example a crankshaft to which it is connected, by means of a chain, for example. The first sun wheel 6 is a rotatably connected to the sprocket/belt pulley 3, it being integrally formed therewith, in particular, said first sun wheel intermeshing in a force-transmitting manner with the first step 12 of the planet wheel 8. A transmission of the rotational motion from the sprocket/belt pulley 3 to the second sun wheel 7, which intermeshes in a force-transmitting manner with the second stage 13 of the planet wheel 8, is possible owing to the different configuration between the first and the second steps 12, 13 of the planet wheel 8. By a rotation of the planet wheel carrier 10, on which the planet wheels 8 are rotatably mounted, a phase adjustment is effected between the camshaft 1 and the drive. The transmission ratio of the planetary gear 5 is characterised as follows:

$$\text{Output rotational speed} = \text{drive rotational speed} \cdot \left[\frac{z_6}{z_{12}}\right] \cdot \left[\frac{z_{13}}{z_7}\right]$$

Wherein Z is the number of the teeth and the numeral of the reference sign of the respective toothed wheel referenced in the figures.

A transmission ratio between the planet wheel carrier 10 and the camshaft 1 is:

$$\text{Output rotational speed} = \text{drive rotational speed} \cdot \left[1 - \left(\frac{z_6}{z_{12}}\right) \cdot \left(\frac{z_{13}}{z_7}\right)\right]$$

In the camshaft 1 shown, the first sun wheel 6 is arranged concentrically to the camshaft 1 and is rotatably arranged independently therefrom. According to FIG. 1, the sprocket/belt pulley 3 is configured integrally on the first sun wheel 6, it also being conceivable that the sun wheel 6 and the sprocket/belt pulley 3 are manufactured separately from one another and are subsequently connected to one another. Since the sprocket/belt pulley 3 exhibits a different rotational speed from the camshaft 1, lubrication must be effected between these two parts. This can, for example, can occur by means of a leakage bore hole of a camshaft bearing. It is also conceivable that the phase adjusting device 4 is sealed with regard to the camshaft 1 in such a manner that, for example, by means of a sealing ring 20, a lubricating oil amount that is introduced once into the interior of the phase adjusting device 4 remains there and can undertake the task of creating lubrication between the sprocket/belt pulley 3 and the camshaft 1.

The planet wheel carrier 10 can be configured in the style of a cage or housing and can be connected to the cover plate 19 by means of a connecting element 21. It is of course also conceivable that the sprocket/belt pulley 3 currently arranged on the right according to FIG. 1 can, in a different embodiment, be arranged on the left. In general, the entire phase adjusting device 4 is enclosed by a housing 22 surrounding it completely, said housing being impenetrable to lubricants at the same time.

The camshaft according to the invention offers the tremendous advantage that a phase adjusting device 4 can be created with a planetary gear 5, which requires only very minimal amount of installation space and furthermore runs very quietly during operation. Moreover, the phase adjusting device 4 according to the invention a larger adjustment angle can be adjusted than with the phase adjusting device disclosed in the prior art. Finally, in addition to the phase adjusting device 4 according to the invention being able to be manufactured simply, mention should also be made of the relatively low inertia of mass of the planetary gear 5, which favourably affects energy balance.

Owing to fact that the phase adjusting device 4 comprises exclusively components, such as, for example, the first sun wheel 6, the second sun wheel 7, the planet wheels 8, and the toothed track 17, which all bear an outwardly-directed toothed ring, the phase adjusting device 4 can altogether be manufactured in a very cost-effective manner with respect to the planetary gear 5.

All of the features in the description and in the following claims can be pertinent to the invention individually and collectively in arbitrary combination.

The invention claimed is:

1. An adjustable camshaft that is connected to a drive, by way of a sprocket/belt pulley comprising:

a phase adjusting device for adjusting the phases between the camshaft and the drive, wherein the phase adjusting device comprises a planetary gear having at least two sun wheels that are arranged coaxially to one another and also comprising planet wheels surrounding said sun wheels, wherein a first sun wheel is connected in a rotationally-fixed manner to the sprocket/belt pulley and accordingly to the drive, and a second sun wheel is attached in a rotationally-fixed manner to the camshaft, and the planet wheels are each rotatably mounted on a planet wheel carrier by way of a planet wheel axis, wherein the planet wheel carrier is rotatably mounted with regard to a camshaft axis in such that a rotation of the planet wheel carrier affects a phase adjustment between the camshaft and the drive, wherein the first sun wheel is one of a component of the sprocket/belt pulley and is configured as integral therewith, and wherein the camshaft comprises:

i. an interior shaft that is coaxially arranged in an exterior shaft, wherein the interior shaft is connected in a rotationally-fixed manner to first cams and the exterior shaft is connected in a rotationally-fixed manner to second cams, and wherein the interior shaft is rotatably mounted relative to the exterior shaft, and ii. a second phase adjusting device is provided for the generation of relative motion.

2. The camshaft as specified in claim 1, wherein the planet wheels are configured in a stepped manner and a respective first step intermeshes with the first sun wheel and a respective second step intermeshes with the second sun wheel.

3. The camshaft as specified in claim 2, wherein a drive device is provided for actuating the phase adjusting device for rotating the planet wheel carrier.

4. The camshaft as specified in claim 3, wherein the drive device comprises a toothed gearing engaging with a toothed track arranged on the planet wheel carrier.

5. The camshaft as specified in claim 1, wherein a drive device is provided for actuating the phase adjusting device for rotating the planet wheel carrier.

6. The camshaft as specified in claim 5, wherein the drive device comprises a toothed gearing engaging with a toothed track arranged on the planet wheel carrier.

7. The camshaft as specified in claim 6, wherein the toothed gearing engages with the toothed track arranged on the planet wheel carrier by way of a worm screw.

8. The camshaft as specified in claim 6, wherein the drive device is operated one of electrically, pneumatically and hydraulically.

9. The camshaft as specified in claim 5, wherein the drive device is operated one of electrically, pneumatically and hydraulically.

10. The camshaft as specified in claim 1, wherein the second sun wheel is tensioned against a front face of the camshaft by way of an axial fixation element.

11. The camshaft as specified in claim 1, wherein the planet wheel carrier is connected to a covering plate that both forms a bearing for the planet wheel axis, said bearing being positioned opposite the planet wheel carrier, and is rotatably mounted with respect to the sprocket/belt pulley.

12. The camshaft as specified in claim 1, wherein the camshaft is connected to a crankshaft, by way of a sprocket/belt pulley.

13. An adjustable camshaft that is connected to a drive, by way of a sprocket/belt pulley comprising:

a phase adjusting device for adjusting the phases between the camshaft and the drive, wherein the phase adjusting device comprises a planetary gear having at least two sun wheels that are arranged coaxially to one another and also comprising planet wheels surrounding said sun wheels, wherein a first sun wheel is connected in a rotationally-fixed manner to the sprocket/belt pulley and accordingly to the drive, and a second sun wheel is attached in a rotationally-fixed manner to the camshaft, and the planet wheels are each rotatably mounted on a planet wheel carrier by way of a planet wheel axis, wherein the planet wheel carrier is rotatably mounted with regard to a camshaft axis in such that a rotation of the planet wheel carrier affects a phase adjustment between the camshaft and the drive, wherein the first sun wheel is one of a component of the sprocket/belt pulley and is configured as integral therewith, wherein the planetary gear is configured in such that the planetary gear affects a transmission of a rotational movement from the drive to the camshaft, and wherein the camshaft comprises:

i. an interior shaft that is coaxially arranged in an exterior shaft, wherein the interior shaft is connected in a rotationally-fixed manner to first cams and the exterior shaft is connected in a rotationally-fixed manner to second cams, and wherein the interior shaft is rotatably mounted relative to the exterior shaft, and ii. a second phase adjusting device is provided for the generation of relative motion.

14. The camshaft as specified in claim 13, wherein the planet wheels are configured in a stepped manner and a respective first step intermeshes with the first sun wheel and a respective second step intermeshes with the second sun wheel.

15. The camshaft as specified in claims 13, wherein a drive device is provided for actuating the phase adjusting device for rotating the planet wheel carrier.

16. The camshaft as specified in claim 15, wherein the drive device comprises a toothed gearing engaging with a toothed track arranged on the planet wheel carrier.

17. The camshaft as specified in claim 13, wherein the second sun wheel is tensioned against a front face of the camshaft by way of an axial fixation element.

18. The camshaft as specified in claim 13, wherein the planet wheel carrier is connected to a covering plate that both forms a bearing for the planet wheel axis, said bearing being positioned opposite the planet wheel carrier, and is rotatably mounted with respect to the sprocket/belt pulley.

* * * * *